US007410071B1

(12) United States Patent
Seib et al.

(10) Patent No.: US 7,410,071 B1
(45) Date of Patent: Aug. 12, 2008

(54) CLOSURE WITH LINER CUTTER

(75) Inventors: Robert J. Seib, Haubstadt, IN (US); Christopher B. Clodfelter, Evansville, IN (US)

(73) Assignee: Rexam Closures and Containers, Inc., Evansville, IN (US)

( * ) Notice: Subject to any disclaimer, the term of this patent is extended or adjusted under 35 U.S.C. 154(b) by 590 days.

(21) Appl. No.: 10/832,914

(22) Filed: Apr. 27, 2004

(51) Int. Cl.
*B65D 41/04* (2006.01)
*B65D 17/44* (2006.01)
*B67D 5/00* (2006.01)

(52) U.S. Cl. ..... 215/228; 215/232; 215/217; 215/334; 220/212; 220/278; 222/80; 222/83

(58) Field of Classification Search ..... 220/277, 220/278, 366.1; 215/217, 220, 228, 334, 215/257, 295, 232, 297; 81/3.09; 7/156; 222/83, 81
See application file for complete search history.

(56) References Cited

U.S. PATENT DOCUMENTS

| | | | | |
|---|---|---|---|---|
| 1,100,433 | A | | 6/1914 | Johnson |
| 2,200,029 | A | | 5/1940 | Kulling |
| 2,297,592 | A | | 9/1942 | Walter |
| 3,931,905 | A | | 1/1976 | Shumway et al. |
| 4,340,147 | A | | 7/1982 | McIntosh |
| 4,634,013 | A | | 1/1987 | Bar-Kokhba |
| 4,709,822 | A | | 12/1987 | Vataru |
| 4,747,501 | A | | 5/1988 | Greaves |
| 4,898,293 | A | * | 2/1990 | Morel ..... 215/250 |
| 5,090,582 | A | | 2/1992 | Art et al. |
| 5,238,130 | A | * | 8/1993 | Marques et al. ..... 215/216 |
| 5,469,980 | A | | 11/1995 | O'Meara et al. |
| 5,657,895 | A | * | 8/1997 | Rogge ..... 220/366.1 |
| 5,709,311 | A | | 1/1998 | Butler et al. |
| 5,797,506 | A | | 8/1998 | Lehmukuhl et al. |
| 5,915,576 | A | * | 6/1999 | Robinson ..... 215/216 |
| 6,024,234 | A | | 2/2000 | Rink et al. |
| 6,039,198 | A | * | 3/2000 | Wolfe et al. ..... 215/228 |
| 6,182,845 | B1 | | 2/2001 | Wolfe et al. |
| 6,386,385 | B1 | | 5/2002 | Amanat et al. |
| 2002/0117501 | A1 | | 8/2002 | Amanat et al. |

* cited by examiner

*Primary Examiner*—Robin Hylton
(74) *Attorney, Agent, or Firm*—James E. Cole; Middleton Reutlinger

(57) ABSTRACT

A closure having a top wall and a skirt depending from a peripheral edge of said top wall. The closure includes an inner skirt depending from the top wall having at least one thread for helically attaching to a container neck. A deflection wall extends from the top wall having an inner diameter greater than a container neck. Extending from the top wall is a cutting device, defined by an axial cutter and a radial cutter for piercing a liner and cutting the liner about a circumference less than 360 degrees such that the liner is partially attached when the cutting process is completed.

11 Claims, 4 Drawing Sheets

CLOSURE WITH LINER CUTTER

BACKGROUND OF THE INVENTION

1. Technical Field of the Invention

The present invention relates generally to a double-shell closure. More particularly, the present invention relates to a double-shell closure having first and second intersecting triangles for cutting a container liner but which leaves a portion of the liner connected to the container rim such that the cut liner does not fall into the container and contact the product therein.

2. Description of the Related Art

Various closure designs are known which provide a piercing element in order to open a liner. However, the prior art patents fails to disclose a closure having a cutter formed of intersecting perpendicular triangles for opening a liner.

In view of currently known closures, it is preferable to have a closure which vents the internal product pressure when a container or package is initially opened while minimizing a consumer's exposure to the product dust produced from internal package pressure during initial package opening.

The present invention provides a double-shell closure for a container having a liner seal extending across a container rim sealing the container and allowing for build up of internal container pressure. The double-shell closure includes an outer skirt depending from a peripheral edge of a top wall and an inner skirt depending from the top wall. The inner skirt comprises at least one thread helically extending along an inner surface of the inner skirt. Extending along the outer surface of the inner skirt from the top wall downward are a plurality of strengthening ribs in a spaced apart relationship. In one exemplary configuration, the strengthening ribs are spaced apart about 11.25 degrees from each other but alternatively the strengthening ribs may be spaced apart in a plurality of configurations.

Along an upper portion of the outer shell are a plurality of knurls for aid in gripping the closure during removal and application of the closure to the container threads and when the closure is inverted for cutting the liner seal during initial opening of the container.

Depending from the lower edge portion of the closure outer skirt are diametrically opposed locking lugs. The locking lugs engage lugs on the container neck to provide a child resistance feature. The locking lugs may be substantially triangular in shape having an inner surface, a tapered deflection surface, and an engaging surface. During application of the closure to the container neck, each deflection surface cams against an inner surface of the container neck locking lug deflecting the closure lugs inward and causing ovalized flexing of the closure outer skirt. The strengthening ribs inhibit any flexing of the inner skirt. Once the closure lugs pass by the container lugs the closure returns to its circular shape and the engaging surface of the closure lug engages the container neck lug so that the closure may not back-off. The engaging surface prevents the closure from backing off of the container neck. Thus the diametrically opposed gripping ribs, each spaced about ninety degrees from the closure lugs, must be squeezed causing ovalized flexing of the closure and radially outward movement of the lugs allowing the closure lugs to move outward beyond the container neck lugs and the closure to be removed from the container neck.

Extending upwardly from the top wall and radially inset from the peripheral edge is a deflection wall. The upwardly extending wall has a diameter slightly larger than the outer diameter of a container neck thread. Also extending from the top wall is an cutter device comprising a first axial cutter and a second radial cutter. When the closure is inverted and placed over a container having a liner seal over the container rim, the axial cutter punctures the seal causing a the liner seal to tear. The radial cutter spreads the liner apart along the tear caused by the axial cutter and pushes the liner into the container. This action continues as the closure is rotated until a small portion of the uncut liner remains connected to the container rim. In other words the liner is not completely broken by the cutter but instead a portion is left intact to prevent the liner from completely falling into the container and thereby minimizing liner contact with the product in the container.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

Figure 6:
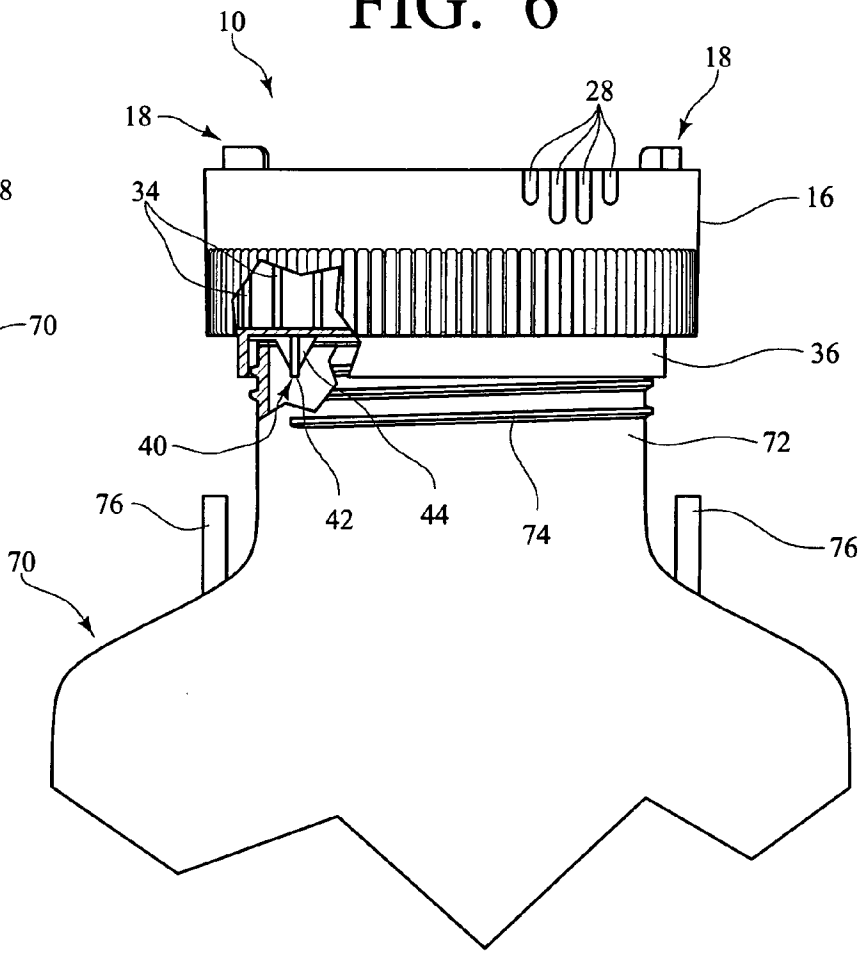
FIG. 6 shows a side view with cut-away portion of the closure of FIG. 1 positioned on the container neck and cutting the liner seal.
Figure 7:
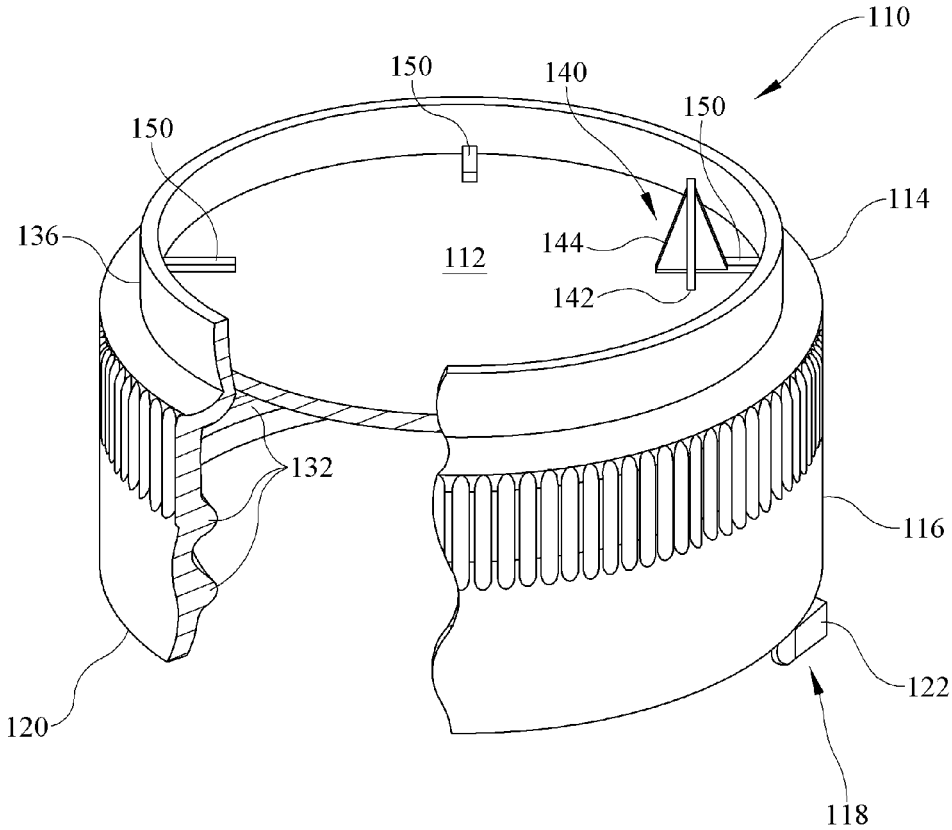
FIG. 7 shows a side perspective view with a cut-away portion of a single shell closure embodiment.

The present invention will now be described in conjunction with the drawings, referring initially to FIGS. 1-4, a closure 10 is shown. Although a double-shell closure is shown and described throughout the application, the closure of FIG. 1 may be a single or double-shell closure as it is well within the scope of the present invention that a single shell closure may be substituted and utilized herewith, as depicted in FIG. 7. Thus the present invention is not limited to a double-shell closure. The closure 10 comprises a top wall 12 having a peripheral edge 14. Depending from the peripheral edge 14 is an outer skirt 16 having diametrically opposed locking lugs 18 depending from a lower edge portion 20 of the outer skirt 16. The lower edge portion 20 defines an opening wherein a container neck 72 may be disposed. Each of the locking lugs 18 may be substantially triangular in shape having an inner surface, a deflecting surface 22, and an engaging surface 24. As shown in FIG. 2, the deflection surfaces 22 are tapered. The tapered surface 22 allows the closure lug to pass on the inside of the container neck lugs 76 which are substantially diametrically opposed along the container neck 72 and provide a child resistance feature. The container lugs 76, best seen in FIGS. 5 and 6, are merely exemplary and may be formed in many shapes and geometries as one of ordinary skill in the art will understand. As the closure 10 is placed on the container neck 72, the deflecting surfaces 22 contact container lugs 76 and the closure 10 flexes into an ovalized form such that the locking lugs 18 pass along an inside surface of the container lugs 76. Once the locking lugs 18 pass the container lugs 76, the closure returns to its circular shape and the closure 10 cannot be backed off the container neck 72 since the engaging surfaces 24 contact the container lugs 76. The child resistance feature must be overcome in order to remove the closure from the container neck 72.

Also located along the outer surface of the outer skirt 16 are a plurality of gripping ribs 28. The gripping ribs 28 are exemplified in FIGS. 1 and 2 as being diametrically opposed and each spaced apart from the closure locking lugs 18 by about 90 degrees. The closure outer skirt 16 is of a thickness such that when an opposed squeezing force is applied to the gripping ribs 28, the outer skirt 16 ovalizes as shown in FIG. 5. By squeezing the gripping ribs 28 and turning the closure 10 in a counterclockwise motion the locking lugs 18 are displaced radially outward a distance allowing them to pass the container lugs 76 thereby defeating the child resistance feature. Thus, the closure 10 may be removed from the container neck 72. An inner skirt 30, seen in FIG. 3, is inhibited from ovalizing by a plurality of ribs 34 spaced about the outer surface of the inner skirt 30 as will be discussed below.

Figure 3:
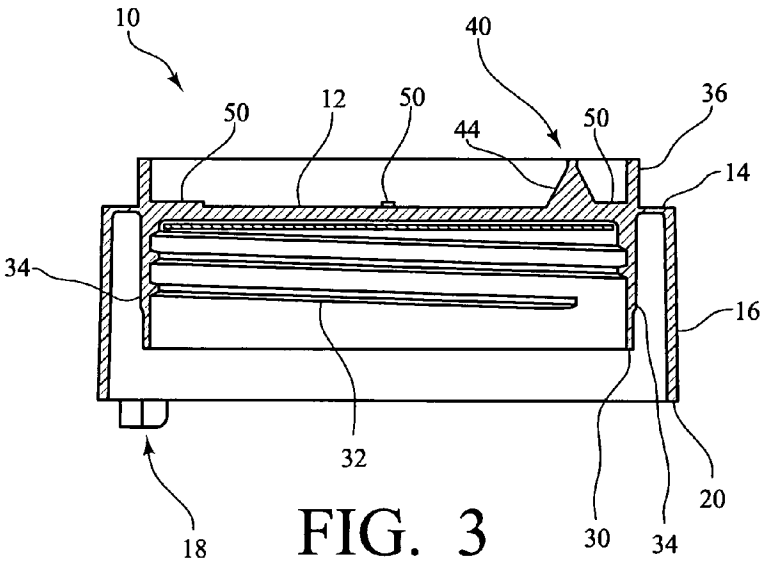
FIG. 3 shows a side sectional view of the double-shell closure of FIG. 1.

Referring now to FIG. 3, as described above the closure 10 also comprises an inner skirt 30. The inner skirt 30 is radially inset from the outer skirt 16 and has an inner surface and an outer surface. Helically extending along the inner surface of the inner skirt 30 is at least one thread 32. The at least one thread 32 threadably engages a container neck 72 thread retaining the closure 10 on the container neck 72. Extending from the outer surface of the inner skirt 30 are a plurality of strengthening ribs 34 which depend downwardly along the inner skirt from the top wall 12. The strengthening ribs 34 also have a substantially rectangular shape and provide at least two advantages. First, the strengthening ribs 34 stabilize the inner skirt 30 with respect to the outer skirt 16 during cooling of the closure 10 as the closure is removed from the mold during manufacturing. Second, the strengthening ribs 34 inhibit ovalized flexing of the inner skirt during repeated opening and closing of the closure 10. In one exemplary embodiment, there are 32 strengthening ribs 34 each spaced apart about 11.25 degrees however, there may be a plurality of various geometries and configurations positioned along the outer surface of the inner skirt 30.

Extending upwardly from the top wall 12 is a deflecting wall 36. The deflecting wall 36 has a diameter which is slightly larger than the maximum outer diameter of a container thread 74. With this arrangement and as shown in FIG. 6, the closure 10 may be inverted and placed over the container rim to enclose the upper portion of the container neck 72, including the container rim. The deflecting wall 36 provides at least two advantages. First, the deflecting wall 36 minimizes contact between the user and the product contained within the container. For example, when the liner seal covering the container mouth is pierced or broken internal pressure from within the container 70 is released. This may cause particulate or other product contained therein to spew from within the container 70 to outside the container 70. The deflection wall 36 directs any product being ejected from the container 70 from the top wall 12 downward along the deflection wall 36 since the closure 10 is in an inverted position during opening, as shown in FIG. 6. As a result, contact between the user and the ejected product is minimized. A second advantage of the deflecting wall 36 is that the deflecting wall 36 centers the inverted closure 10 over the container neck 72 so that the cutter 40, described below, may pierce and open the seal liner of the container 70 adjacent the container rim.

Figure 1:
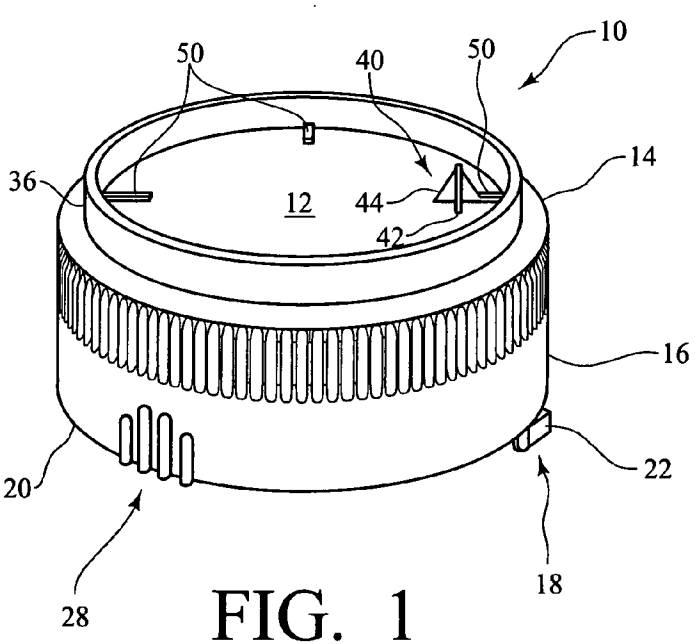
FIG. 1 shows a perspective view of the double-shell closure of the instant invention.
Figure 2:
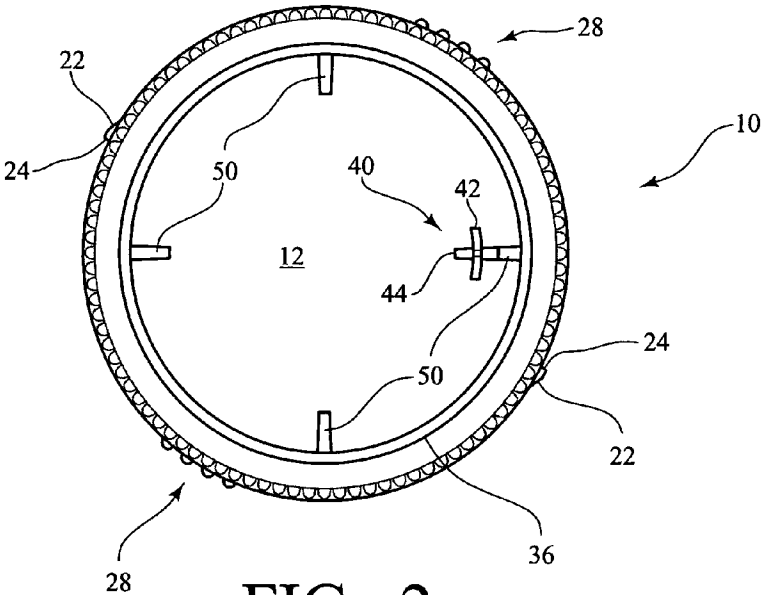
FIG. 2 shows a top view of the double-shell closure of FIG. 1.

As shown in FIGS. 1 and 2, extending from the top wall of the closure 10 is a cutter 40. The cutter 40 is defined by two projections, a first axial cutter 42 and a second radial cutter 44 and is located radially outward from the center of the top wall 12 and inset from the deflecting wall 36. The first axial cutter 42 may have a triangular shape and, as exemplified in FIG. 7, the triangle defining the first axial cutter 42 is an isosceles triangle, however the triangle may alternatively be an equilateral triangle, as shown in FIG. 1. The top of the first cutter 42 forms a point for piercing a seal liner however the sides of the triangle are substantially flat, rather than sharpened, so that the seal liner tears as the closure 10 is rotated.

The second radial cutter 44 is also an isosceles triangle however, the radial cutter may alternatively be an equilateral triangle. The radial cutter 44 extends in a radial direction, substantially orthogonal to the axial cutter 42 and intersecting the axial cutter 42 at vertical centerlines. The radial cutter 44 has a height that is less than the height of the axial cutter 42. The radial cutter 44 has at least two functions. First, the radial cutter 44 inhibits the seal liner from sealing around the axial cutter 42 when the seal liner is initially pierced. More specifically the spaces defined by about 90 degrees between the radial and axial cutter inhibit the seal liner from sealing against the axial cutter 42. Therefore pressure is relieved from within the container immediately when the closure 10 is inverted and placed over the container neck 72. Second, the radial cutter 44 spreads the seal liner where it is cut by the axial cutter 42 and pushes the seal liner downward into the container.

Extending radially inward from the deflecting wall 36 are feet 50. As best exemplified in FIG. 2, the feet 50 extend radially inward from the deflecting wall 36 and are spaced apart about 90 degrees, however the feet 50 may be spaced apart in a plurality of configurations and at a plurality of arcuate distances. As depicted, the feet 50 are substantially rectangular in shape however various alternative shapes and tapers may be substituted. The feet 50 are raised from the top wall 12 of the closure 10 some distance and provide an air gap between the top wall of the closure 10 and the container rim when the seal liner is initially opened, as depicted in FIG. 6. The feet may be a uniform height, stepped, or tapered in order to provide the air gap. The air gap provided by feet 50 allows the container 70 to vent when the seal liner is pierced and any product which sprays from within the container 70 is directed into the deflecting wall and downward, away from a user.

Figure 4:
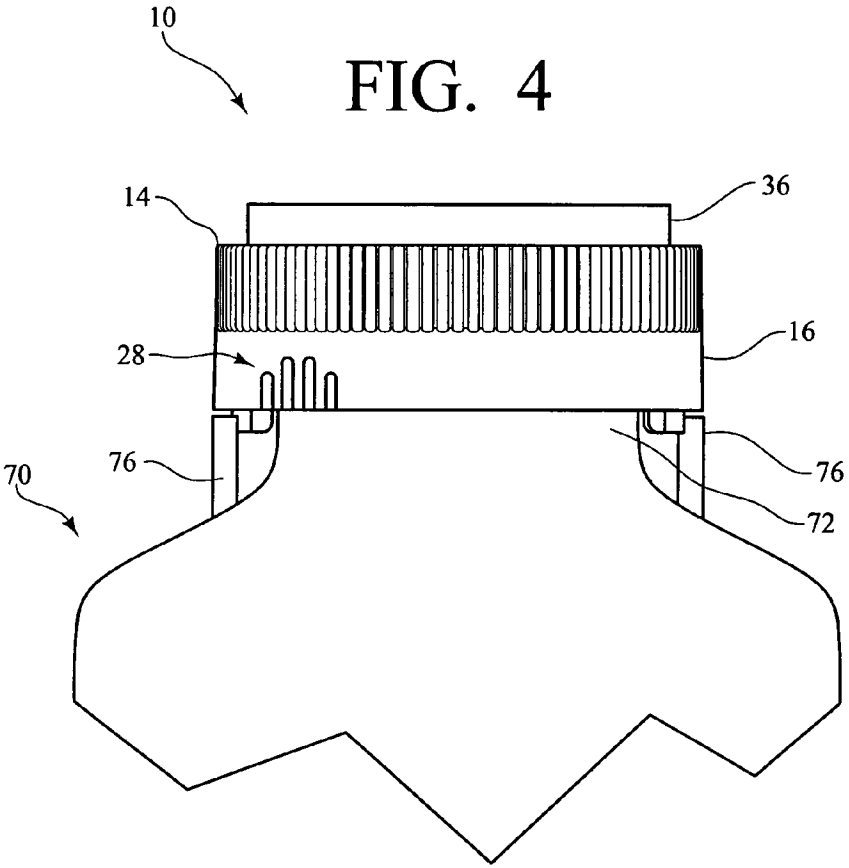
FIG. 4 shows the closure of FIG. 1 positioned on a container neck.
Figure 5:
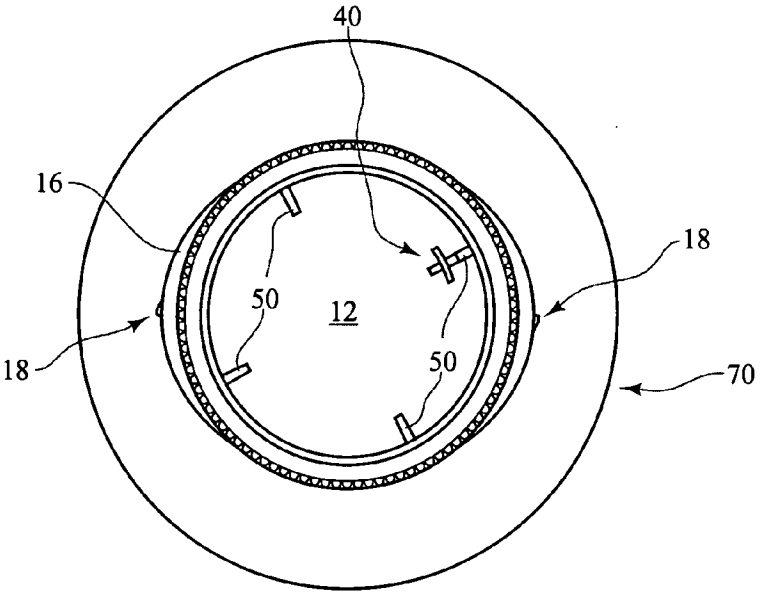
FIG. 5 shows a top view of the closure deflecting as it passes the engaging lugs of the container neck.

In use, the closure 10 is threadably disposed on the container neck 72 as shown in FIG. 4. To remove the closure 10 from the container neck 72 a squeezing force is applied to each of the gripping ribs 28. Upon application of sufficient force to the gripping ribs 28, the closure 10 will flex into an ovalized shape and the closure lugs 18 will move radially outward beyond the container lugs 76. When the engaging surface is spaced outward from the container neck lugs 76, the child resistance feature is overcome and the closure 10 may be removed from the container neck 72.

Upon removing the closure 10 from the container neck 72, the closure 10 is inverted, the deflection wall 36 is aligned over the container rim, and the cutter 40 is pressed through a liner disposed over the container 70 opening, as shown in FIG. 6. As the cutter 40 pierces the liner, the feet 50 engage the container rim providing an air gap between the container rim and the top wall 12 of the closure 10. Meanwhile, as the liner is pierced internal pressure from the container 70 may be released forcing particulate material upward to the closure top wall 12 and downward along the deflection wall 36 away from a user.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

We claim:

1. A combination container and double shell closure with liner cutter, comprising:

a container having a neck defining an opening and a liner positioned over said opening;

container lugs extending from a shoulder of said container;

a closure having a top wall and a peripheral edge;

an outer skirt depending downwardly from said peripheral edge of said top wall;

an inner skirt depending downwardly from said top wall having an outer surface and an inner surface, a thread helically extending along said inner surface of said inner skirt, and a plurality of strengthening ribs depending downwardly from said top wall along said outer surface of said inner skirt;

a deflection wall extending upwardly from said top wall;

a cutter extending from said top wall defining an axial cutter and a radial cutter formed of intersecting triangles wherein said axial triangle extends above said radial triangle.

2. The combination container and double shell closure with liner cutter of claim 1, said axial cutter and said radial cutter being isosceles triangles in shape.

3. The combination container and double shell closure with liner cutter of claim 1, said outer skirt having diametrically opposed gripping ribs.

4. The combination container and double shell closure with liner cutter of claim 3, said closure having a diametrically opposed closure lugs depending from a lower edge of said outer skirt, said closure lugs each spaced apart about 90 degrees from said gripping ribs.

5. The combination container and double shell closure with liner cutter of claim 4, said closure lugs having an inner surface, an engaging surface, and a deflection surface.

6. The combination container and double shell closure with liner cutter of claim 1, said deflection wall being radially inset from said peripheral edge of said top wall.

7. A double shell closure with liner cutter, comprising:

a top wall having a peripheral edge;

an outer skirt depending downwardly from said peripheral edge;

an inner skirt depending downwardly from said top wall having an inner surface with a thread extending helically along said inner surface of said inner skirt and a plurality of ribs depending from said top wall along said outer surface of said inner skirt;

a deflection wall extending upwardly from said top wall and radially inset from said peripheral edge;

an x-cutter defining an axial cutter and a radial cutter, said axial cutter and said radial cutter each formed by an isosceles triangle, said isosceles triangles being perpendicular and intersecting along respective centerlines;

said x-cutter cutting a liner through a radial arc between about 200 degrees and 340 degrees.

8. The double shell closure with liner cutter of claim 7 wherein said closure is inverted, said x-cutter pierces said liner relieving pressure from a container and directing expelled particulate along said deflection wall and away from said top wall.

9. The double shell closure of claim 8, said closure spreading a portion of said liner and directing said liner into said container.

10. The double shell closure of claim 8, said deflection wall having a diameter greater than an outer diameter of a container neck thread.

11. The double shell closure with liner cutter of claim 8, said axial and radial cutters having flat edges.

* * * * *